US007428391B2

(12) United States Patent
Kobayashi

(10) Patent No.: US 7,428,391 B2
(45) Date of Patent: Sep. 23, 2008

(54) IMAGE FORMING DEVICE AND METHOD OF CONTROLLING THE IMAGE FORMING DEVICE

(75) Inventor: Kazunori Kobayashi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 59 days.

(21) Appl. No.: 11/478,602

(22) Filed: Jul. 3, 2006

(65) Prior Publication Data

US 2007/0014586 A1 Jan. 18, 2007

(30) Foreign Application Priority Data

Jul. 5, 2005 (JP) ..... 2005-196628
Jun. 2, 2006 (JP) ..... 2006-154978

(51) Int. Cl.
*G03G 15/00* (2006.01)

(52) U.S. Cl. ..... 399/88

(58) Field of Classification Search ..... 399/8, 399/70, 75, 88, 90

See application file for complete search history.

(56) References Cited

U.S. PATENT DOCUMENTS

| | | | | |
|---|---|---|---|---|
| 6,895,196 | B2 * | 5/2005 | Uchizono et al. | 399/75 |
| 2002/0114000 | A1 | 8/2002 | Kobayashi | |
| 2004/0004732 | A1 * | 1/2004 | Takeda et al. | 358/1.13 |
| 2004/0151513 | A1 * | 8/2004 | Nomura | 399/8 |
| 2004/0190916 | A1 * | 9/2004 | Seeler et al. | 399/8 |

FOREIGN PATENT DOCUMENTS

| | | |
|---|---|---|
| CN | 1497411 A | 5/2004 |
| JP | 11-126000 | 5/1999 |
| JP | 2002-078197 | 3/2002 |
| JP | 2003-087432 | 3/2003 |
| JP | 2004-112680 | 4/2004 |
| JP | 2004-341276 | 12/2004 |

OTHER PUBLICATIONS

Chinese Office Action dated Apr. 25, 2008 for corresponding Chinese Application No. 2006101002669 and English translation thereof.

* cited by examiner

*Primary Examiner*—Sandra L Brase
(74) *Attorney, Agent, or Firm*—Harness Dickey & Pierce

(57) ABSTRACT

In an image forming device including a system control unit, an image formation unit forming an image on a recording sheet using a predetermined process, an image forming control unit controlling image formation, and a power supply unit supplying power to the image formation unit, the image forming control unit, and the system control unit in response to a control signal. A return factor monitoring unit detects occurrence of a return factor to a normal mode during a power saving mode, and outputs a notification signal indicating return factor information relating to a detected return factor, to the image forming control unit before starting of the system control unit is completed. An initialization necessity judgment unit determines whether initializing the predetermined process is needed at a time of returning to the normal mode, based on the return factor information.

10 Claims, 10 Drawing Sheets

FIG.2

| NOTIFICATION SIGNAL sig2 | | | RETURN FACTORS |
|---|---|---|---|
| BIT 2 | BIT 1 | BIT 0 | |
| 0 | 0 | 0 | MAIN POWER SWITCH TURNED ON |
| | | 1 | FIRST RETURN FACTOR SENSOR SIGNAL ASSERTED |
| | 1 | 0 | SECOND RETURN FACTOR SENSOR SIGNAL ASSERTED |
| | | 1 | THIRD RETURN FACTOR SENSOR SIGNAL ASSERTED |
| 1 | 0 | 0 | POWER SWITCH OF OPERATION PANEL TURNED ON |
| | | 1 | DATA RECEIVED FROM FIRST EXTERNAL INTERFACE |
| | 1 | 0 | DATA RECEIVED FROM SECOND EXTERNAL INTERFACE |
| | | 1 | DATA RECEIVED FROM THIRD EXTERNAL INTERFACE |

IMAGE FORMING DEVICE AND METHOD OF CONTROLLING THE IMAGE FORMING DEVICE

BACKGROUND OF THE INVENTION

1. Field of the Invention

The present invention relates to an image forming device having a power saving mode, including a printing device, a facsimile device, a copying device and a digital copier, and relates to a method of controlling the image forming device.

2. Description of the Related Art

In recent years, there is a great demand for power saving of image forming devices from a viewpoint of environmental protection. In the case of the image forming device utilizing the electrophotographic process, the power consumption of its fixing unit is dominant. And the widely used method for attaining power saving of the image forming device is to suppress or stop the supply of electric power so that a temperature of the fixing unit in the standby mode is lower than that of the fixing unit in the active mode.

Recently, there is proposed an image forming device which stops the supply of electric power to not only the fixing unit but also the whole image forming device or most of the functional parts thereof during the power saving mode. For example, see Japanese Laid-Open Patent Application No. 11-126000.

According to the above-mentioned image forming device, it is possible to reduce the power consumption in the standby mode to less than several watts (W) by setting the image forming device in the power saving mode, and it is possible to increase the power-saving effect.

However, even when a return factor which is detected by the system control unit during the power saving mode does not require initialization processing of the electrophotographic process (for example, when a device management command, such as an inquiry of paper size of a main part cassette, is received from an external device connected to the image forming device via a network), the engine control unit starts performing the initialization of the electrophotographic process as soon as it is started, without awaiting the completion of starting of the system control unit. For this reason, in the case of the above-mentioned image forming device, there are such problems that the unnecessary power consumption may arise or noises may occur accompanied with the initialization processing.

SUMMARY OF THE INVENTION

According to one aspect of the invention, there is provided an improved image forming device and its controlling method in which the above-described problems are eliminated.

According to one aspect of the invention there is provided an image forming device in which the supply of power to the CPU of the system control unit is stopped in the power saving mode, the image forming device adapted to effectively suppress the unnecessary initialization of the electrophotographic process when a return factor to the normal mode occurs during the power saving mode, so that the power consumption can be reduced and the occurrence of noises can be suppressed.

In an embodiment of the invention which solves or reduces one or more of the above-mentioned problems, there is provided an image forming device comprising: a system control unit; an image formation unit forming an image on a recording sheet using a predetermined process; an image forming control unit controlling image formation by the image formation unit; a power supply unit supplying power to at least the image formation unit, the image forming control unit, and the system control unit in response to a control signal received from the system control unit; a return factor monitoring unit provided in the system control unit to detect occurrence of a return factor to a normal mode during a power saving mode, wherein the return factor monitoring unit outputs, when occurrence of a return factor to the normal mode during the power saving mode is detected, a notification signal indicating return factor information relating to the detected return factor, to the image forming control unit before starting of the system control unit is completed; and an initialization necessity judgment unit determining whether initializing the predetermined process is needed at a time of returning to the normal mode, based on the return factor information indicated by the notification signal.

The above-mentioned image forming device may be configured so that the return factor monitoring unit is provided to output a pulse-width-modulation pulse carrying the return factor information relating to the detected return factor, to the image forming control unit via one or more communication lines.

The above-mentioned image forming device may be configured so that an error detecting unit is provided to determine that an error arises, when a pulse-width-modulation pulse outputted by the return factor monitoring unit is continuously at high level or low level over a period of a fixed time.

The above-mentioned image forming device may be configured so that the power supply unit supplies power to the return factor monitoring unit even in the power saving mode, so that the return factor monitoring unit operates in the power saving mode.

The above-mentioned image forming device may be configured so that, when the return factor monitoring unit detects occurrence of a return factor to the normal mode during the power saving mode, the system control unit controls the power supply unit to resume the supply of power to at least the image formation unit, the image forming control unit, and the system control unit.

The above-mentioned image forming device may be configured so that the initialization necessity judgment unit is provided to determine whether initializing an electrophotographic process used by the image formation unit is needed at the time of returning to the normal mode, based on a code indicated by a digital signal which is received as the notification signal from the return factor monitoring unit.

The above-mentioned image forming device may be configured so that the initialization necessity judgment unit is provided to determine whether initializing an electrophotographic process used by the image formation unit is needed at the time of returning to the normal mode, based on a pulse width of a pulse-width-modulation pulse which is received as the notification signal from the return factor monitoring unit.

The above-mentioned image forming device may be configured so that the return factor monitoring unit is provided to control the power supply unit in the normal mode to supply power to at least the image formation unit, the image forming control unit, and the system control unit, and provided to control the power supply unit in the power saving mode to stop the supply of power to the image formation unit, the image forming control unit, and the system control unit.

The above-mentioned image forming device may be configured so that the image forming control unit is connected to the system control unit through a command line.

Moreover, in an embodiment of the invention which solves or reduces one or more of the above-mentioned problems, there is provided a method of controlling an image forming device comprising a system control unit, an image formation unit forming an image on a recording sheet using a predetermined process, an image forming control unit controlling image formation by the image formation unit, and a power supply unit supplying power to at least the image formation unit, the image forming control unit, and the system control unit in response to a control signal received from the system control unit, and a return factor monitoring unit provided in the system control unit to detect occurrence of a return factor to a normal mode during a power saving mode, the method comprising: outputting, when occurrence of a return factor to the normal mode is detected during the power saving mode, a notification signal indicating return factor information relating to the detected return factor, to the image forming control unit before starting of the system control unit is completed; and determining whether initializing the predetermined process is needed at a time of returning to the normal mode, based on the return factor information indicated by the notification signal.

According to embodiments of the image forming device and its controlling method of the invention, the initialization of the electrophotographic process may be performed only when the return factor to the normal mode requires image formation. When the return factor to the normal mode does not require image formation, the unnecessary initialization of the electrophotographic process is suppressed, so that the power consumption can be reduced and the occurrence of noises can be suppressed.

BRIEF DESCRIPTION OF THE DRAWINGS

Other objects, features and advantages of the present invention will be apparent from the following detailed description when reading in conjunction with the accompanying drawings.

FIG. 2 is a diagram for explaining a method of notification using, as a notification signal, a digital signal carrying one of discretely separate codes which are respectively assigned for different return factors to the normal mode which may occur during the power saving mode.

DETAILED DESCRIPTION OF PREFERRED EMBODIMENTS

Before describing embodiments of the invention, a description will be given of related art image forming devices in order to provide good understanding of the invention by comparison.

Figure 9:
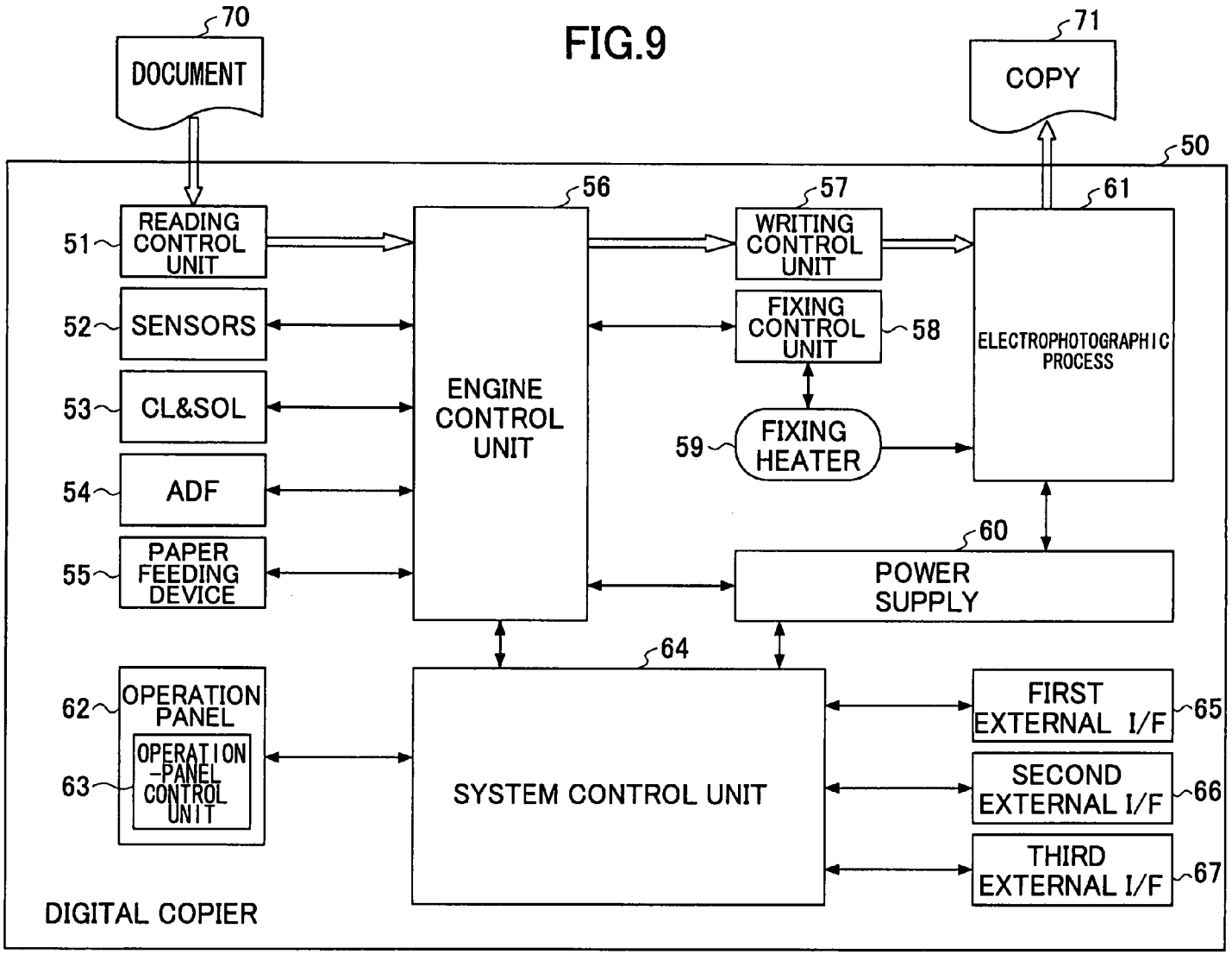
FIG. 9 is a block diagram showing the composition of a digital copier.

FIG. 9 shows the composition of a digital copier which is a related art image forming device. In the digital copier 50 of FIG. 9, image data of a document 70 is read out by the reading control unit 51, and the image processing of the image data is carried out by the image processing portion (not shown) of the engine control unit 56, and the processed image data is transmitted to the writing control unit 57.

To the engine control unit 56, the sensors 52, the clutches and solenoids (CL&SOL) 53, the automatic document feeding device (ADF) 54, and the paper feeding device 55 are also connected. The sensors 52 include the ADF document sensor to detect setting of a document on the ADF 54, and the pressure plate open/close detection sensor to detect the open/closed state of the pressure plate for pressing the document on the contact glass. The automatic document feeding device (ADF) 54 feeds the document automatically. In the paper feeding device 55, a large number of recording sheets are stored and the recording sheets are fed one by one.

The writing control unit 57 performs emission control of a laser diode based on the image data sent by the image processing unit, so that an electrostatic latent image is formed on the photoconductor (not shown) by the laser beam from the writing control unit 57 using the known electrophotographic process 61.

In the electrophotographic process 61, the surface of the photoconductor is charged, the charged surface of the photoconductor is exposed to the laser beam, and the electrostatic latent image is formed on the photoconductor surface. The formed electrostatic latent image is developed with a toner, and a toner image is formed. The formed toner image is transferred to a recording sheet (copy paper) conveyed from the paper feeding device 55, and the fixing unit (not shown) heated by the fixing heater 59 fixes the toner image to the recording sheet, so that a copy 71 is produced.

The fixing heater 59 is controlled by the engine control unit 56 and the fixing control unit 58 so that the fixing unit is maintained at a desired temperature during operation.

The above-mentioned image formation operation is controlled by the system control unit 64, so that the storage and processing of image data and the adjustment of various modes of operation can be attained.

In the operation panel 62 which realizes a user interface, the input unit and the display (both not shown) on the operation panel 62 are controlled by the operation panel control unit 63 provided in the operation panel 62. Similar to the image formation operation, the input data inputted from the input unit of the operation panel 62 and the display data outputted to the display of the operation panel 62 are controlled by the system control unit 64.

The 1st-3rd external interfaces 65-67 are connected to the system control unit 64 respectively, to connect the digital copier 50 and an external device, such as a printer or facsimile, so that data communication between the digital copier 50 and the external device via a network is possible. When an operation including printing and facsimile transmission and reception of the external device is requested, the digital copier 50 is controlled by the system control unit 64, so that the operation of a multi-function peripheral device is realized.

Next, the power saving mode in the digital copier of FIG. 9 will be explained.

Generally, in the power saving mode, the power consumption is reduced by controlling the temperature of the fixing heater 59 to a temperature lower than that at the time of image formation operation, or by stopping the supply of power. The power saving mode is also called an off-mode or a sleep mode.

During the power saving mode, the supply of power to the parts of the digital copier 50 other than a part of the system control unit 64 and the sensors 52 which detect occurrence of a normal-mode returning event (called a return factor) and the 1st-3rd external interfaces 65-67, is stopped, and the power consumption is remarkably reduced.

In the case of the digital copier of FIG. 9, when the signal outputted from the sensors 52 which detect occurrence of a return factor to the normal mode during the power saving mode is asserted (activated), the system control unit 64 asserts, in response to the occurrence of one of the return factors, the power supply control signal which is outputted to the power supply 60. And the supply of power from the power supply 60 to the engine control unit 56 and the image formation unit including the electrophotographic process 61 is resumed so that the digital copier 50 returns to the normal mode. For example, the occurrence of the return factor may include the open/closed state of the pressure plate detected by the pressure plate open/close detection sensor, the setting of the document on the ADF 54 is detected by the ADF document sensor, the depression of the power switch of the operation panel 62, and the occurrence of the data received from the 1st-3rd external interfaces 65-67.

Figure 10:
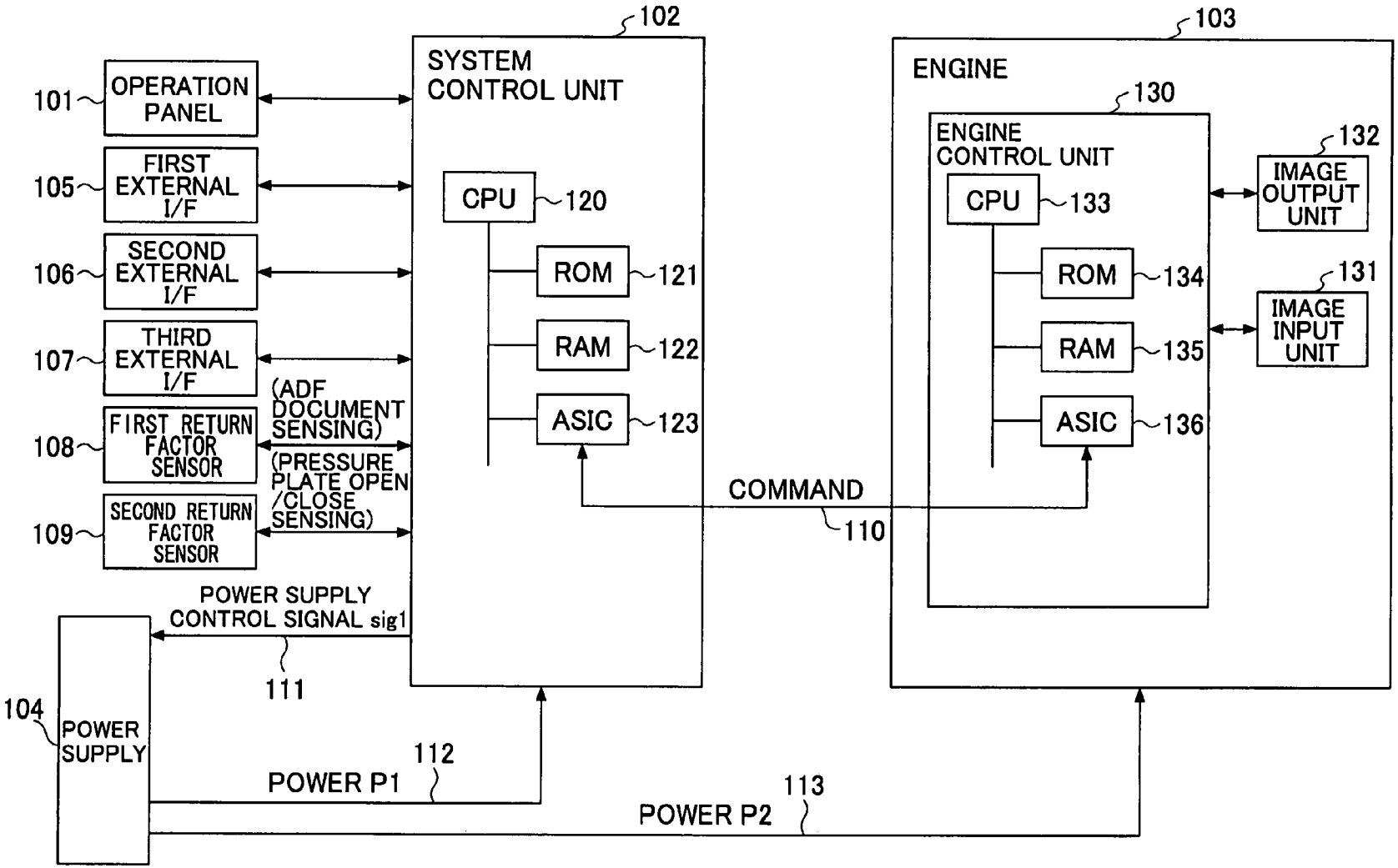
FIG. 10 is a block diagram showing the composition of another digital copier.

FIG. 10 shows the composition of another related art digital copier. In the digital copier of FIG. 10, the operation panel 101 which realizes a user interface is connected to the system control unit 102.

The system control unit 102 controls the input unit and the display (both not shown) of the operation panel 101, receives the input data inputted from the input unit of the operation panel 101, and outputs the display data being displayed on the display of the operation panel 101.

The 1st-3rd external interfaces 105-107 are connected to the system control unit 102 respectively, to connect this digital copier to an external device, such as a personal computer, so that data communication between the digital copier and the external device via a network is possible.

Under the control of the system control unit 102, the operations including a printer function to cause the engine 103 to print the data received from the external device on a recording sheet, a facsimile transmitting function to transmit fax data to an external device via a communication line, such as a public telephone network, a facsimile reception function to receive fax data from an external device via a communication line, and an image reading function are realized.

The 1st return factor sensor 108 is, for example, the ADF document sensor which detects setting of a document on the ADF. The 2nd return factor sensor 109 is, for example, the pressure plate open/close detection sensor which detects the open/closed state of the pressure plate for pressing the document on the contact glass. These sensors are sensors which detect occurrence of a return factor to the normal mode during the power saving mode.

The system control unit 102 comprises the CPU 120, the ROM 121, the RAM 122, and the ASIC 123. The CPU 120 performs input/output processing of the operation panel 101 and the 1st-3rd external interfaces 105-107 as well as control of the engine 103, by executing the program stored in the ROM 121 using the RAM 122 as the working area.

Transferring of a control command to the engine 103 is performed through the command line 110 via the ASIC 123.

The engine 103 comprises the engine control unit 130, the image input unit 131, and the image output unit 132. The image input unit 131 is the reading control unit which inputs into the engine control unit 130 the image data read from the document by the scanner device. The writing control unit which writes image data after the output unit 132 outputs the image processing by the engine control unit in the electrophotographic process, the surface of the photoconductor is charged, the charged surface of the photoconductor is exposed to laser beam, and an electrostatic latent image is formed on the photoconductor. The formed electrostatic latent image is developed with a toner, and the toner image is formed. The formed toner image is fixed to a recording sheet (copy paper) conveyed from the paper feeding device, by the fixing unit heated by the fixing heater, and a copy is produced. These operations are carried out by the electrophotographic process 61.

The engine control unit 130 comprises the CPU 133, the ROM 134, the RAM 135, and the ASIC 136. The CPU 133 controls the image formation processing in the engine 103 by executing the program stored in the ROM 134 using the RAM 135 as the working area.

Transferring of the control command from the system control unit 102 to the engine 103 is performed through the command line 110 via the ASIC 136.

The digital copier of FIG. 10 stops the supply of power from the power supply 104 to the respective units including the fixing control unit (not shown), the fixing heater (not shown), and the operation panel 101 during the power saving mode.

In order to shift to the power saving mode from the normal mode, the system control unit 102 negates (or deactivates) the power supply control signal sig1 being outputted to the power supply 104 through the power supply control signal line 111.

While the power supply 104 continues the supply of power P1 to the system control unit 102 via the power supply line 112, the power supply 104 stops the supply of power to the operation panel 101 in response to the negated power supply control signal.

Since the power supply 104 also stops the supply of power P2 to the engine 103 via the power supply line 113, the supply of power to the image input unit 131, the image output unit 132, the fixing control unit, the fixing heater, and the engine 103 is stopped.

In the digital copier of FIG. 10, in the power saving mode, the supply of power P2 is stopped, and the CPU 133 of the engine control unit 130 does not operate. However, the supply of power P1 via the power supply line 112 is maintained, and the CPU 120 of the system control unit 102 operates.

The reason for maintaining the supply of power to the system control unit 102 during the power saving mode is that it must take a certain amount of time when starting the operating system (OS) of a UNIX (registered trademark) system since the system control unit 102 is adapted for allowing network communication.

Although it may say that starting from power stoppage takes time to such OS it is required of the data receiving processing from the 1st-3rd external interfaces 105-107 instance, and to processing of the received data, since the CPU 120 is required, the supply of power to the CPU 120 cannot be stopped due to the composition including the 1st-3rd external interfaces 105-107.

There is also a digital copier (called a basic system) which has the composition of the above-mentioned digital copier but does not include any external interface.

The digital copier which includes no external interface has been explained with reference to FIG. 10, but the 1st-3rd external interfaces 105-107 may be omitted from the configuration in this case.

In the case of the basic system, the supply of electric power to the CPU 120 can be stopped during the power saving mode.

The return to the normal mode from the power saving mode in the basic system is performed according to occurrence of return factors, such as a depression of the 1st—the asserted state of the output signal of the 2nd return factor sensors 108-109, and the power switch on operation panel 101 (not shown). It is carried out when either of the above-mentioned return factors occurs.

The system control unit 102 asserts the power supply control signal sig1 outputted to the power supply 104 through the power supply control signal line 111, and the power supply 104 resumes the supply of power P1 to the CPU 120 of the system control unit 102, and the supply of power P2 to the engine 103 accordingly.

Next, operation of the engine in the related art digital copier at the time of returning to the normal mode from the power saving mode will be explained.

1. In the basic system, suppose that the supply of power to the CPU 120 of the system control unit 102 is stopped in the power saving mode. In the power saving mode, returning to the normal mode is carried out when one of the return factors, including the asserted state of the output signal of the 1st return factor sensor 108 or the 2nd return factor sensor 109, and the depression of the power switch of the operation panel 101, occurs.

Since it can be considered that the operation is an operation of a user who intends to use the image forming device as a copier, the system control unit 102 asserts the power supply control signal sig1 to power supply 104, and resumes supply of the power from power supply 104 to each unit containing the CPU 120 and engine 103. The engine 103 starts by performing initialization processing of the electrophotographic process required for image formation in response to the supply of power.

2. In the digital copier having the 1st-3rd external interfaces 105-107, suppose that the supply of power to the CPU 120 of system control unit 102 is not stopped during the power saving mode. In this case, returning to the normal mode from the power saving mode is carried out when either of the asserted state of the output signal of the 1st return factor sensor 108 or the 2nd return factor sensor 109, the data receiving from the 1st-3rd external interfaces 105-107, and the depression of the power switch of the operation panel 101 occurs.

The system control unit 102 asserts the power supply control signal sig1, and resumes the supply of power from the power supply 104 to the respective units including the engine 103.

The engine 103 starts by performing the initialization processing of the electrophotographic process required for image formation in response to the supply of power as in the case of the basic system mentioned above.

However, when the return to the normal mode from the power saving mode occurs by the data receiving from the 1st-3rd external interfaces 105-107, the processing changes with the kind of the data received from the external interfaces.

For example, the print processing to print image data on the recording sheet must be performed when the print data is received from the 1st external interface 105, the system control unit 102 asserts the power supply control signal sig1, and resumes the supply of power from the power supply 104 to the respective units including the engine 103, and similar to the case of the basic system, in response to the supply of power, the engine 103 performs initialization processing of the electrophotographic process required for the image formation, while the engine 103 is started.

However, when a device management command, such as "paper-size inquiry in the main part cassette", is received from the 1st external interface 105, the initialization processing of the electrophotographic process is unnecessary, and the system control unit 102 asserts the power supply control signal sig1.

The supply of power to the engine 103, which is limited to the engine control unit 130, is resumed by the power supply 104, and only the engine control unit 130 is started. And the engine control unit 130 notifies the paper size to the system control unit 102 in response to the inquiry.

Since the initialization processing of the electrophotographic process is accompanied also by occurrence of noise, according to the kind of the return factor to the normal mode, not only it consumes power, but needs to change control of whether to process initialization of the electrophotographic process.

The control command from system control unit 102 determines selection of whether initialization processing of the electrophotographic process is performed while the engine 103 is started, and whether to make it start without carrying out.

Namely, in the basic system, when the supply of electric power from the power supply 104 to the CPU 120 of the system control unit 102 is stopped the power saving mode, the engine control unit 130 starts by performing the initialization processing of the electrophotographic process.

However, since the starting of the OS of the system control unit 102, it must take certain time for the system control unit 102 cannot issue the control command within a fixed time at the engine control unit 130.

In the digital copier which has the 1st-3rd external interfaces 105-107, when the supply of electric power from the power supply 104 to the CPU 120 of the system control unit 102 is not stopped, the engine control unit 130 is started by performing initialization processing of the electrophotographic process.

In this case, since the OS of the system control unit 102 has started, the control command can be executed in the fixed time by the engine control unit 130.

When the return factor to the normal mode from the power saving mode is either the asserted state of the output signal of the 1st return factor sensor 108 and the 2nd return factor sensor 109, or the depression of the power switch of operation panel 101, the control command "start with the electrophotographic process initialization" is transmitted within a fixed time to the engine control unit 130.

When the return factor to the normal mode from the power saving mode is the data receiving from the 1st-3rd external interfaces 105-107 and the print processing is not needed, the control command "start without the electrophotographic-process initialization" is transmitted within a fixed time to the engine control unit 130.

In the case of the image forming device having the external interface, the supply of power to the CPU cannot be stopped in order to receive data from the external device at any times, and there is a problem that the power consumption greatly increases when compared with the case of the basic system having no external interface. While the ratio of printer option installation is increasing with the spreading of network devices and color image forming devices, it is desirable to overcome the above problem also in consideration of environmental problems.

To overcome the problem in the case of the image forming device including the external interface, the improvement of the ASIC is under study, in order to realize the function to activate the processing of the external interface only for the period until starting of the CPU is completed, so that the supply of power to the CPU can be stopped.

Since the supply of power to the CPU can be stopped during the power saving mode, the problem that the power consumption greatly increases when compared with the case of the basic system can be eliminated.

Figure 11:
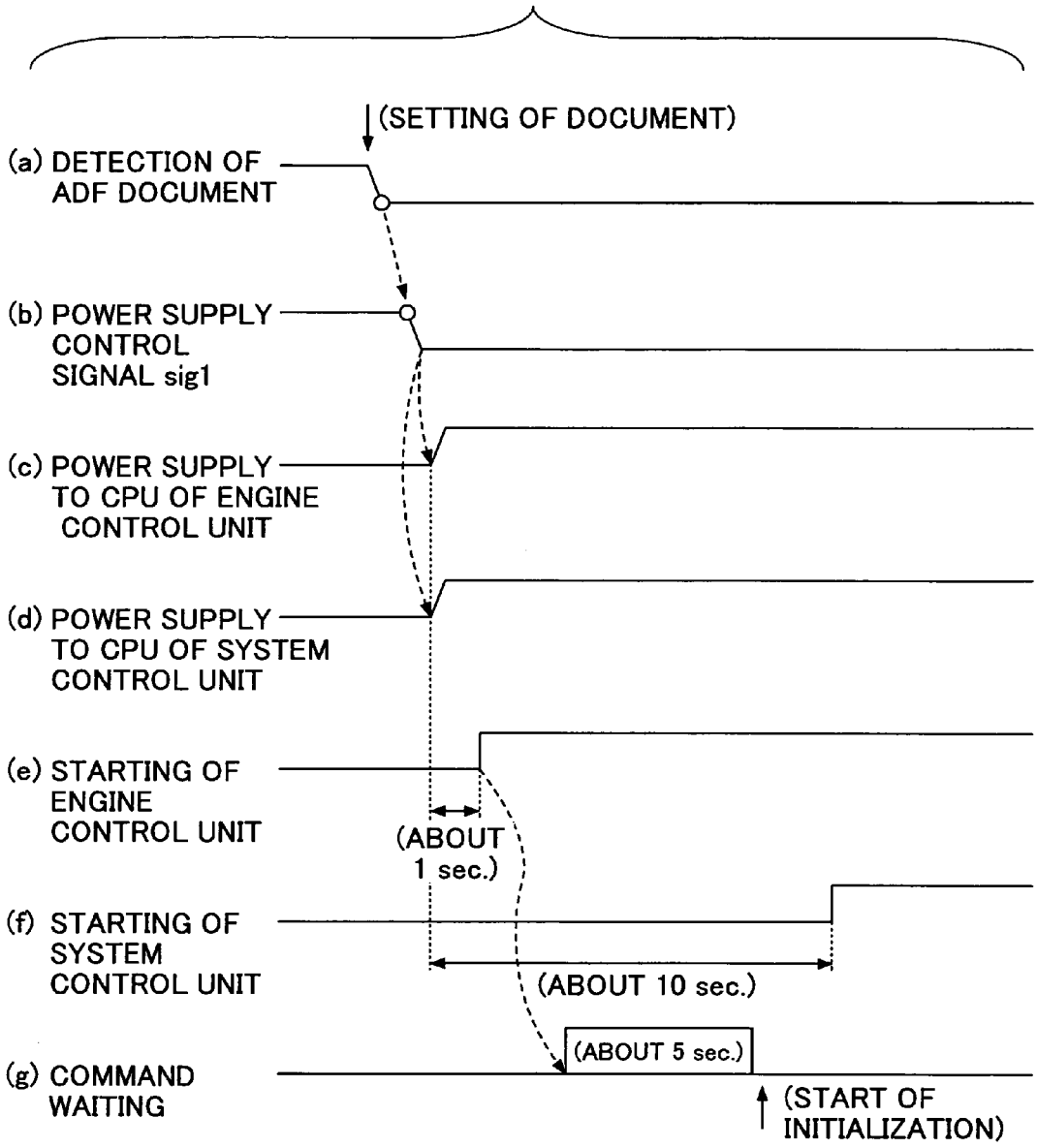
FIG. 11 is a timing chart for explaining operation of an image forming device when a return factor to the normal mode occurs during the power saving mode.

FIG. 11 is a timing chart for explaining operation of the related art image forming device when the asserted state of the output signal of the 1st return factor sensor 108 occurs as a return factor from the power saving mode to the normal mode.

For the sake of convenience, suppose that the image forming device of this example is the basic system, and the supply of power to the CPU 120 of the system control unit 102 is stopped during the power saving mode.

When the 1st return factor sensor 108 detects setting of a document on the ADF by the user as shown in FIG. 11(*a*), the system control unit 102 asserts the power supply control signal sig1 to the power supply 104 (FIG. 11(*b*)).

In response to the asserted state the power supply control signal sig1, the power supply 104 resumes the supply of power to the respective units including the CPU 120 and the engine 103 (FIG. 11(*c*), (*d*)).

At this time, when the CPU 133 of engine 103 receives the supply of power, the CPU 133 is immediately started (FIG. 11(*e*)). However, the CPU 120 of the system control unit 102 requires a certain amount of time until starting of the CPU 120 is completed (FIG. 11(*f*)).

Even if the CPU 120 is still starting, the CPU 133 is already started and receives the command from the command line 110. Then, the engine control unit 130 performs initialization processing of the electrophotographic process required for image formation, so that the engine is started (FIG. 11(*g*)).

However, even when the return factor which is detected by the system control unit during the power saving mode does not require initialization processing of the electrophotographic process, the engine control unit starts performing the initialization of the electrophotographic process as soon as it is started, without awaiting the completion of starting of the system control unit. For this reason, in the case of the above-mentioned image forming device, there are such problems that the unnecessary power consumption may arise or noises may occur accompanied with the initialization processing.

A description will be given of embodiments of the invention with reference to the accompanying drawings.

An image forming device in an embodiment of the invention is adapted to effectively suppress the unnecessary initialization of the electrophotographic process when a return factor to the normal mode occurs during the power saving mode, so that the power consumption can be reduced and the occurrence of noises can be suppressed, as described below.

Figure 1:
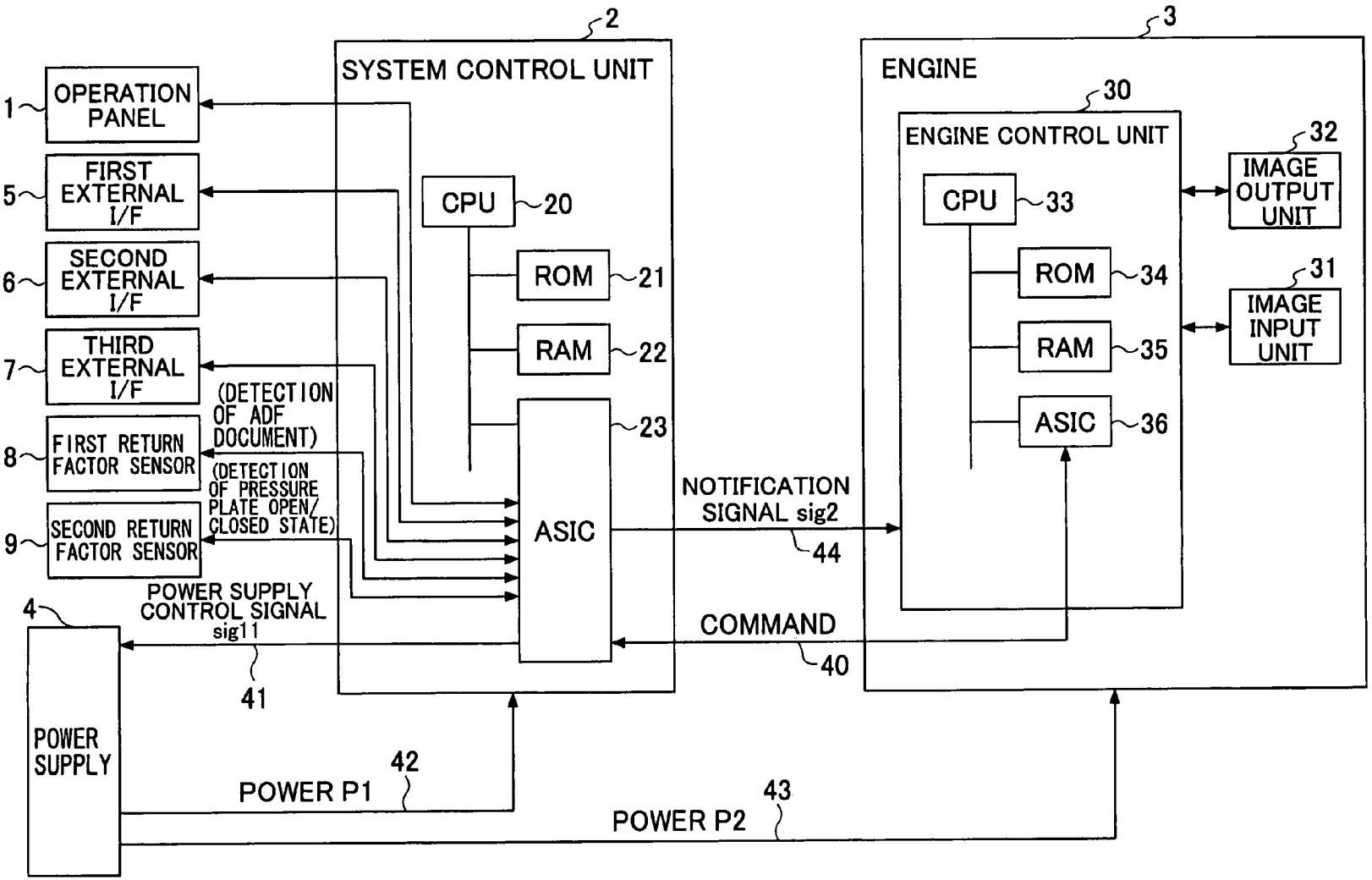
FIG. 1 is a block diagram showing the composition of an image forming device in an embodiment of the invention.

FIG. 1 shows the composition of a digital copier in an embodiment of the invention.

In the digital copier of FIG. 1, the operation panel 1 which realizes a user interface is connected to the ASIC 23 of the system control unit 2. The system control unit 2 controls the input unit and the display (both not shown) of the operation panel 1.

Under the control of the system control unit 2, the data inputted from the input unit of the operation panel 1 is received at the ASIC 23, and the data being displayed is outputted to the display of the operation panel 1 through the ASIC 23.

The 1st-3rd external interfaces 5-7 are connected to the ASIC 23 of the system control unit 2 respectively, and this digital copier can be connected to an external device, such as a personal computer, via a network so as to realize data communication via the network.

The system control unit 2 transmits data to or receives data from an external device through the ASIC 23. During the normal mode, one of a printer function which prints the data received from the external device on a recording sheet by using the engine 3, a facsimile transmitting or receiving function which transmits facsimile data to or receives facsimile data from an external device via a communication line, such as a public telephone network, and an image reading function is realized under the control of the system control unit 2.

The 1st-3rd external interfaces 5-7 serve as the function of an external interface unit which connects the image forming device with an external device, so that data communication between the image forming device and the external device is possible.

The 1st return factor sensor 8 and the 2nd return factor sensor 9 are connected to the ASIC 23, respectively. The 1st return factor sensor 8 is, for example, a document detection sensor which detects setting of a document on the ADF (automatic document feeder). The 2nd return factor sensor 9 is, for example, a pressure plate open/closed state detection sensor which detects the open/closed state of the pressure plate for pressing the document onto the contact glass. These sensors detect occurrence of a return factor to the normal mode during the power saving mode and send a result of the detection to the ASIC 23.

The operation panel 1, the 1st return factor sensor 8, and the 2nd return factor sensor 9 constitute an input unit which inputs the operation information to this digital copier.

The system control unit 2 comprises the CPU 20, the ROM 21, the RAM 22, and the ASIC 23. The CPU 20 controls the operation panel 1, the 1st-3rd external interfaces 5-7, and the engine 3 by executing the program stored in the ROM 21 and using the RAM 22 as the working area. The ASIC 23 transfers the control command to the engine 3 sent by the CPU, to the engine control unit 30 of the engine 3 through the command line 40. The system control unit 2 constitutes a system control unit which controls the whole image forming device including the engine control unit 30 (image forming control unit).

Even during the power saving mode, the ASIC 23 receives the supply of electric power from the power supply 4, and therefore the ASIC 23 operates in the power saving mode.

The ASIC 23 detects occurrence of a return factor to the normal mode during the power saving mode. Various return factors detected by the ASIC 23 during the power saving mode may include the depression of the power switch on the operation panel 1, the input of data receiving from the external device via the 1st-3rd external interfaces 5-7, the asserted state of an output signal from the 1st return factor sensor 8 (the ADF document sensor) when setting of a document on the ADF is detected, and the asserted state of an output signal from the 2nd return factor sensor 9 (pressure plate open/closed state detection sensor) when the open/closed state of the pressure plate for pressing a document onto the contact glass is detected. The ASIC 23 in this case functions as the return factor monitoring unit.

When occurrence of one of the return factors is detected, the ASIC 23 asserts the power supply control signal sig1 and outputs the asserted power supply control signal to the power supply 4 via the power supply control signal line 41.

In response to the asserted power supply control signal sig1, both the supply of power P1 from the power supply 4 through the power supply line 42 to the CPU 20, the ROM 21, and the RAM 23 of the system control unit 2, and the supply of power P2 from the power supply 4 through the power supply line 43 to the engine 3 and the engine control unit 30 are resumed.

As soon as the occurrence of one of return factors is detected, the ASIC 23 outputs the notification signal sig2 indicating return factor information relating to the detected return factor, to the engine control unit 30 through the notification signal line 44 before starting of the CPU 20 of the system control unit 2 is completed. The ASIC 23 in this case achieves the function which outputs the notification signal sig2 to the engine control unit 30 as the return factor monitoring unit.

Next, a description will be given of the above-mentioned function of the ASIC 23 which outputs the notification signal sig2 to the engine control unit 30 as soon as the occurrence of a return factor is detected during the power saving mode.

Figure 7:
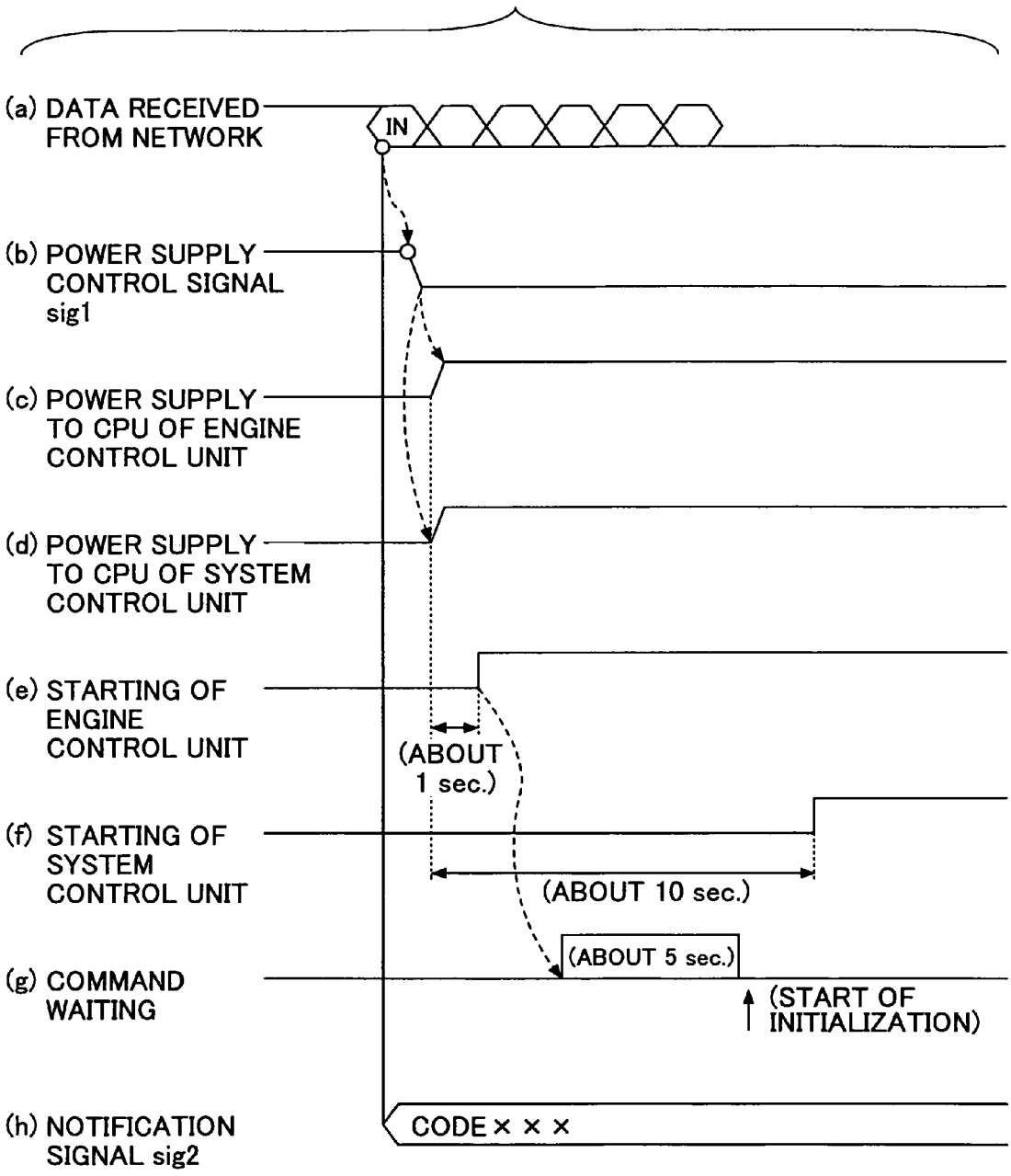
FIG. 7 is a timing chart for explaining operation of the image forming device of the invention when a return factor to the normal mode occurs during the power saving mode.

FIG. 7 is a timing chart for explaining operation of the image forming device of the invention when the data receiving of the 1st external interface 5 from an external device via a network occurs as a return factor to the normal mode during the power saving mode.

As mentioned above, in the image forming device of FIG. 1, the supply of electric power to the CPU 20 of the system control unit 2 is stopped in the power saving mode. Suppose that, in this example, the data received from the 1st external interface 5 is print data, and the print processing to print the data on a recording sheet must be performed.

When the ASIC 23 detects the input of the data receiving of the 1st external interface 5 from the external device via the network as shown in FIG. 7(*a*), the ASIC 23 asserts the power supply control signal sig1 to the power supply 4 (FIG. 7(*b*)).

In response to the asserted power supply control signal sig1, the power supply 4 resumes the supply of power to the respective units including the CPU 20 of the system control unit 2 and the CPU 33 of the engine 3 (FIG. 7(*c*), (*d*)).

At this time, the CPU 33 of the engine 3 is immediately started when the supply of power is received (FIG. 7(*e*)). However, it takes a certain time until starting of the CPU 20 of the system control unit 2 is completed (FIG. 7(*f*)).

Since the CPU 33 receives the command transmitted from the command line 40 even if the CPU 20 is still starting, the engine control unit 30 performs initialization processing of the electrophotographic process required for image formation, and starts the engine (FIG. 7(*g*)).

On the other hand, as soon as the occurrence of the return factor is detected, the ASIC 23 outputs the notification signal sig2 indicating the information (return factor information) relating to the detected return factor, to the engine control unit 30 through the notification signal line 44 before the starting of the CPU 20 of the system control unit 2 is completed (FIG. 7(*h*)).

Irrespective of the instant the CPU 20 completes the starting and the instant the CPU 33 completes the starting, the ASIC 23 outputs the notification signal sig2 to notice the engine control unit 30 of the return factor information simultaneously when the ASIC 23 detects the occurrence of the return factor.

In the digital copier of FIG. 1, the notification signal line 44 comprises one or a plurality of signal lines (which are also called hard lines).

When only one signal line is used, the contents of the notification signal are changed, and the information indicating the contents of two or more kinds of return factors is notified.

When two or more signal lines are used, the return factors of various kinds are notified by sending notification signals through the two or more signal lines in combination, the notification signals corresponding to the contents of two or more kinds of return factors.

In the normal mode, the ASIC 23 controls the power supply 4 (power supply unit) so that the power from the power supply 4 is supplied to at least the engine 3 (image formation unit), the engine control unit 30 (image forming control unit), the system control unit 2 (system control unit), the operation panel 1 (input unit), and the external interface unit. And in the power saving mode, the ASIC 23 performs the function to stop the supply of power from the power supply 4 (power supply unit) to at least the engine 3 (image formation unit), the engine control unit 30 (image forming control unit), and the system control unit 2 (system control unit).

It is possible for the image forming device of this embodiment to control the received data from the 1st-3rd external interfaces 5-7 before starting of the CPU 20 is completed, when returning to the normal mode from the power saving mode.

The engine 3 comprises the engine control unit 30, the image input unit 31, and the image output unit 32. The image input unit 31 is a reading control unit which inputs to the engine control unit 30 the image data read from the document by the scanner unit.

The image output unit 32 includes the optical writing unit which modulates the emitted laser beam according to the image data that is subjected to the image processing by the engine control unit, and writes optically the image to the surface of the photoconductor (not shown) by the laser beam. The image output unit 32 includes the image formation unit which forms an image on a recording sheet by the electrophotographic process. In the image formation unit, the surface of the photoconductor is charged, the charged surface of the photoconductor is exposed to the laser beam, so that an electrostatic latent image is formed on the photoconductor surface. Moreover, in the image formation unit, the formed electrostatic latent image is developed with a toner to form a toner image on the photoconductor, and the formed toner image is fixed to the recording sheet (copy paper) conveyed from the paper feeding device, by using the fixing unit heated by the fixing heater, so that a copy is formed.

In the initialization processing of the electrophotographic process, the initialization of the photoconductor, the charging unit, the transfer unit, the fixing unit, etc., which are contained in the image formation unit, is mainly performed.

The engine control unit 30 comprises the CPU 33, the ROM 34, the RAM 35, and the ASIC 36. The CPU 33 controls the above-mentioned processing in engine 3 by executing the program stored in the ROM 34 using the RAM 35 as the working area.

Transferring of the control command of engine 3 of the ASIC 23 of system control unit 2 is performed through command line 40 via the ASIC 36.

The engine control unit 30 achieves the function of the image forming control unit which controls the image formation by the image formation unit.

The ASIC 36 achieves the function of the initialization necessity judgment unit which determines whether initializing the electrophotographic process is needed or not at the time of returning to the normal mode, based on the return factor information which is notified to the engine control unit 30 (image forming control unit) by the ASIC 23.

The power supply 4 achieves the functions of the power supply unit including the supply of power to the operation panel 1, the 1st-3rd external interfaces 5-7, the 1st return factor sensor 8 and the 2nd return factor sensor 9 through the power supply line (which is not shown), the supply of power P1 to the system control unit 2 through the power supply line 42, and the supply of power P2 to the engine 3 and the engine control unit 30 through the power supply line 43.

In the digital copier of FIG. 1, in order to shift from the normal mode to the power saving mode, the ASIC 23 negates the power supply control signal sig1.

In response to the negated power supply control signal sig1, the power supply 4 stops both the supply of power P2 to the engine 3 and the engine control unit 43, and the supply of power P1 to the system control unit 2. In this case, the supply of power to the operation panel 1, the 1st-3rd external interfaces 5-7, the 1st return factor sensor 8, the 2nd return factor sensor 9, and the ASIC 23 of the system control unit 2 is maintained.

Therefore, the image output unit 32, the fixing control unit, the fixing heater, and the engine 3 are deactivated, and the image input unit 31 is not permitted to receive input data.

Next, operation of the digital copier at the time of returning to the normal mode from the power saving mode will be explained.

As a return factor to the normal mode during the power saving mode, either of the asserted state of the output signal of the 1st return factor sensor 8 or the 2nd return factor sensor 9, the depression of the power switch of the operation panel 1, and the data receiving from the 1st-3rd external interfaces 5-7 may occur. The ASIC 23 when the power supply control signal sig1 is asserted and the notification signal line 44 is made of a single signal line, the notification signal sig2 indicating the return factor information shown in FIG. 2 is notified to engine control unit 30 through notification signal line 44.

FIG. 2 is a diagram for explaining a method of notification using, as the notification signal, a digital signal carrying one of discretely separate codes which are respectively assigned for different return factors to the normal mode which may occur during the power saving mode.

As shown in FIG. 2, suppose that the notification signal sig2 is a three-bit digital signal. When it is detected that the main power switch of the digital copier is turned ON, the ASIC 23 outputs the notification signal sig2 having the bits 2-0 "000", to the engine control unit 30.

When the output signal of the 1st return factor sensor 8 is asserted, the ASIC 23 outputs notification signal sig2 having the bits 2-0 "001", to the engine control unit 30.

When the output signal of the 2nd return factor sensor 9 is asserted, the ASIC 23 outputs the notification signal sig2 having the bits 2-0 "011", to the engine control unit 30.

Although illustration is omitted, when the 3rd return factor sensor is provided and the output signal of the 3rd return factor sensor is asserted, the ASIC 23 outputs the notification signal sig2 having the bits 2-0 "111", to the engine control unit 30.

When it is detected that the power switch of the operation panel 1 of the digital copier is turned ON, the ASIC 23 outputs the notification signal sig2 having the bits 2-0 "100", to the engine control unit 30.

When the data received from the 1st external interface 5 occurs, the ASIC 23 outputs the notification signal sig2 having the bits 2-0 "101", to the engine control unit 30.

When the data received from the 2nd external interface 6 occurs, the ASIC 23 outputs the notification signal sig2 having the bits 2-0 "110", to the engine control unit 30.

When the data received from the 3rd external interface 7 occurs, the ASIC 23 outputs the notification signal sig2 having the bits 2-0 "111", to the engine control unit 30.

The power supply 4 resumes the supply of power P1 and P2 in response to the power supply control signal sig1 received from the ASIC 23 of the system control unit 2. In response to the supply of power, the system control unit 2 and the engine control unit 30 are started. When the bits of the notification signal sig2 are set to "000", "001", "010", "011" or "100", it is considered that the user intends to use the digital copier as a copying machine. In these cases, the engine control unit 30 controls the engine 3 so that it is started by performing initialization processing of the electrophotographic process needed for image formation.

When the bits of the notification signal sig2 are set to "110", "101" or "111", the return factor from the power saving mode to the normal mode of the engine control unit 30 is a case where the data receiving from the 1st-3rd external interfaces 5-7 occurs.

The print processing to print the image data on the recording sheet is required when the data received from the external device via the ASIC 23 is the printer print data. In this case, initialization processing of the electrophotographic process required for the image formation is performed, and the engine 3 is started.

However, since the initialization processing of the electrophotographic process is unnecessary when a device management command including an inquiry of the paper size in the main unit cassette is received from the external device, the initialization processing of the electrophotographic process of the engine 3 is not performed.

In this case, only the engine control unit 30 is started and the engine control unit 30 notifies the paper size in the main unit cassette to the system control unit 2.

The judgment of whether the initialization processing of the electrophotographic process is performed and the engine 3 is started, or whether the engine 3 is started without performing the initialization processing, is carried out by the ASIC 36 of the engine control unit 30 based on both the contents of the notification signal sig2 received from the ASIC 23 of the system control unit 2 via the notification signal line 44, and the contents of the command received from the ASIC 23 of the system control unit 2 via the command line 43.

Thus, the engine control unit 30 can detect the details of the return factor information, and carries out selectively the initialization processing of the electrophotographic process while the engine 3 is started, or the engine 3 is started without performing the initialization processing. It is possible to suppress occurrence of the unnecessary power consumption or noise.

Figure 8:
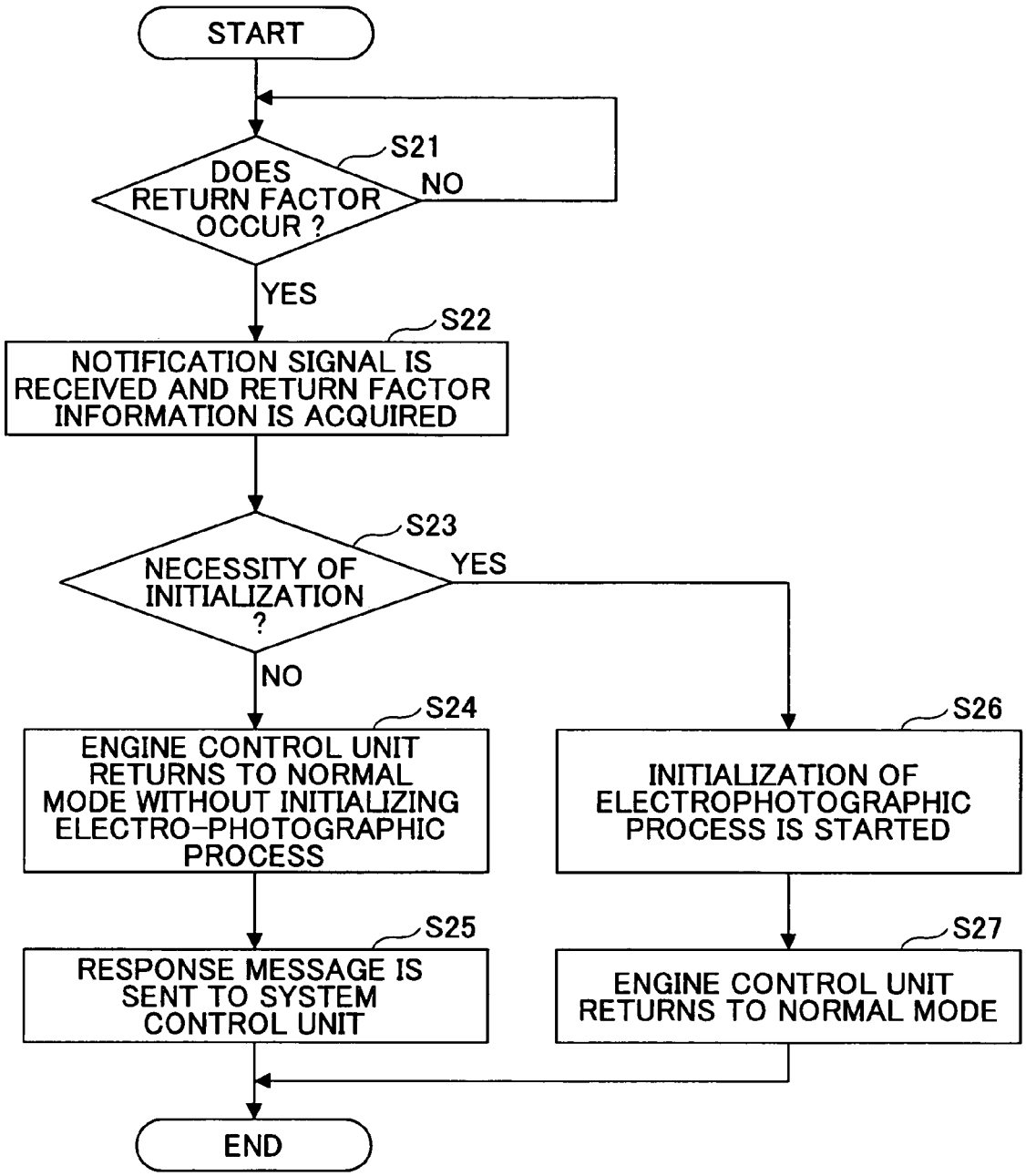
FIG. 8 is a flowchart for explaining the processing performed by the engine control unit of the image forming device of the invention.

FIG. 8 is a flowchart for explaining the processing performed by the engine control unit of the image forming device of the invention.

As mentioned above, the ASIC 23 of system control unit 2 monitors the occurrence of a return factor to the normal mode during the power saving mode.

The ASIC 23 outputs the notification signal sig2 which indicates the return factor information relating to the detected return factor, to the engine control unit 30 through the notification signal line 44 simultaneously when the occurrence of one of return factors is detected.

The engine control unit 30 at step S21 detects whether an input of the notification signal sig2 from the notification signal line 44.

When there is an input of the notification signal line 44 at step S21, the engine control unit 30 at step S22 acquires the return factor information indicated by the notification signal sig2 received from the notification signal line 44.

The engine control unit 30 at step S23 determines whether initializing the electrophotographic process is needed at the time of returning to the normal mode, based on the return factor information acquired at step S22. The engine control unit 30 in this case functions as the initialization necessity judgment unit.

When the method of notification of FIG. 2 is used, a table is stored beforehand in the ROM 134, and this table defines the correlation between the codes assigned to the two or more return factors and the information indicating necessity of the initialization processing of the electrophotographic process corresponding to each code. And the CPU 133 refers to this table.

By referring to the above-mentioned table, the CPU 133 can determine the necessity of the initialization processing of the electrophotographic process based on the return factor information indicated by the notification signal sig2.

Alternatively, the initialization necessity judgment unit which realizes the above-mentioned function to determine the necessity of the initialization processing of the electrophotographic process may be formed as a circuit element in the ASIC 36.

When it is determined at step S23 that the return factor does not require the initialization processing of the electrophotographic process, the engine control unit 30 at step S24 returns to the normal mode without performing the initialization processing of the electrophotographic process.

At step S25, the engine control unit 30 sends a response message back to the system control unit 2 via the command line 40. And the processing of FIG. 8 is terminated.

When it is determined at step S23 that the return factor requires the initialization processing of the electrophotographic process, the engine control unit 30 at step S26 starts the initialization processing of the electrophotographic process.

At step S27, the engine control unit 30 returns to the normal mode. And the processing of FIG. 8 is terminated.

Alternatively, the method of using a pulse-width-modulation (PWM) pulse to notify the return factor information may be utilized.

Figure 3A:
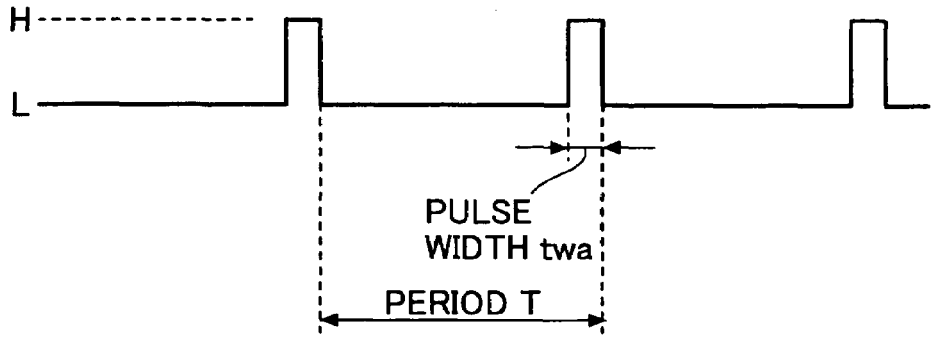
FIG. 3A, FIG. 3B and FIG. 3C are diagrams for explaining a method of notification using, as a notification signal, one of pulse-width-modulation pulses in which discretely separate pulse widths are respectively assigned for different return factors to the normal mode which may occur during the power saving mode.
Figure 3B:
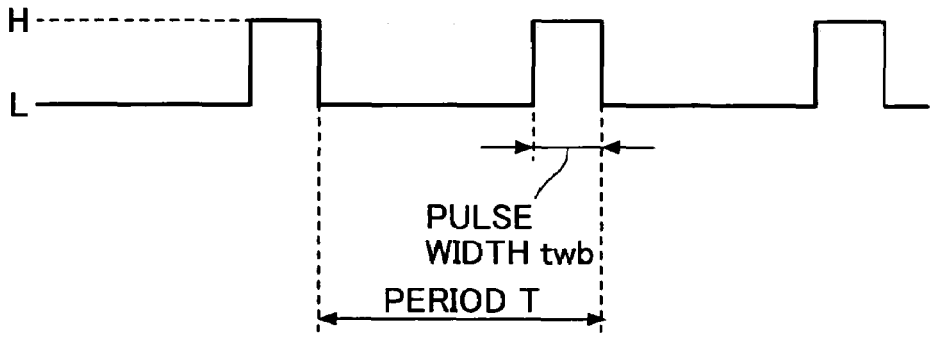
Figure 3C:
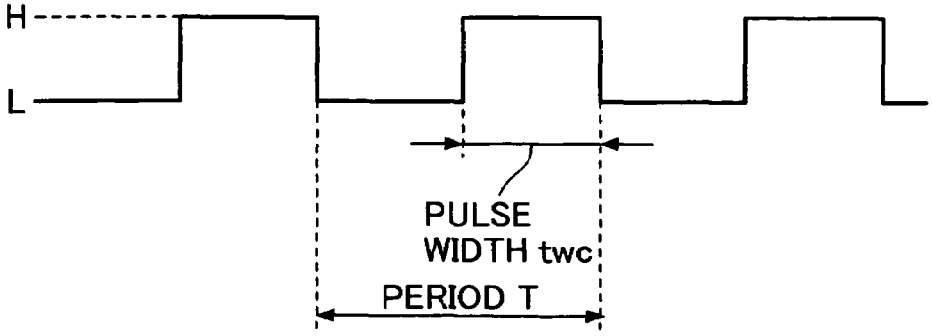

FIG. 3A, FIG. 3B and FIG. 3C are diagrams for explaining a method of notification using, as the notification signal, a pulse-width-modulation pulse in which discretely separate pulse widths are respectively assigned for the different return factors to the normal mode which may occur during the power saving mode.

FIG. 3A shows the waveform of a notification signal sig2 outputted when the signal of the 1st return factor sensor 8 is asserted. This notification signal is a pulse-width-modulation pulse which has a period T and is set at the high level for a predetermined pulse width twa within the period T.

FIG. 3B shows the waveform of a notification signal sig2 outputted when the power switch of the operation panel 1 is set to ON. This notification signal is a pulse-width-modulation pulse which has a period T and is set at the high level for a predetermined pulse width twb within the period T.

FIG. 3C shows the waveform of a notification signal sig2 outputted when the data receiving from the 1st external interface 5 occurs. This notification signal is a pulse-width-modulation pulse which has a period T and is set at the high level for a predetermined pulse width twc within the period T.

In this manner, the pulse width or duty of the respective notification signals is changed so that the conditions twa<twb<twc are met, and these notification signals indicates the return factors of different kinds, respectively. In this example, suppose the case in which a hard line is provided as the notification signal line.

It is a matter of course that the combination of two or more hard lines may be used instead without being limited to this example. Thus, it is possible to reduce the number of the hard lines as the notification means, and it is possible to reduce the cost of a digital copier.

When the notification method of FIG. 3 is used, it is preferred to provide the engine control unit 30 of the image forming device of the invention with an error detecting unit which determines that an error arises, when the pulse-width-modulation pulse is continuously at the high level or the low level over a period of a fixed time.

Figure 4:
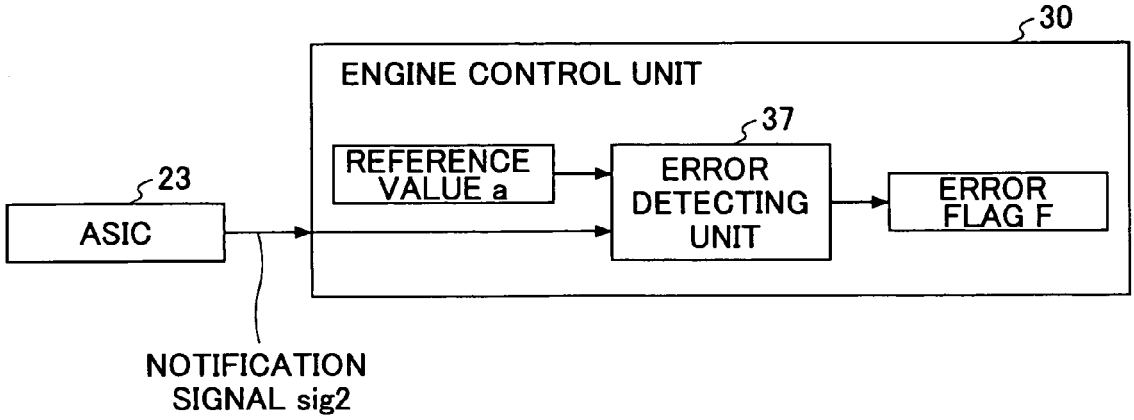
FIG. 4 is a block diagram showing the functional composition of an error detecting unit provided in an engine control unit of the image forming device in an embodiment of the invention.

FIG. 4 shows the functional composition of the error detecting unit 37 provided in the engine control unit 30.

The error detecting unit 37 is constituted by a monitoring timer. The error detecting unit 37 detects whether the input of the edge of the notification signal sig2 from the ASIC 23 occurs within the period indicated by a reference value "a" which is stored beforehand.

When there is no edge input of the notification signal sig2 from the ASIC 23 within the period indicated by the reference value a, the error detecting unit 37 asserts the error flag F.

Figure 5A:
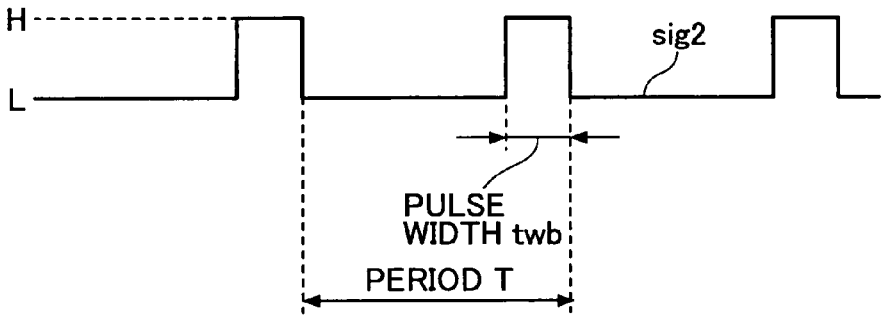
FIG. 5A and FIG. 5B are diagrams showing the waveform of a notification signal sent to the engine control unit in a normal condition, and the waveform of a notification signal sent to the engine control unit in an error condition.

FIG. 5A shows the waveform of a notification signal sig2 which is outputted in a normal condition. When this notification signal sig2 is received, the error detecting unit 37 determines that no error arises, by detecting the edge input of the received signal having the pulse width twb which falls within the period T indicated by the reference value a.

Figure 5B:
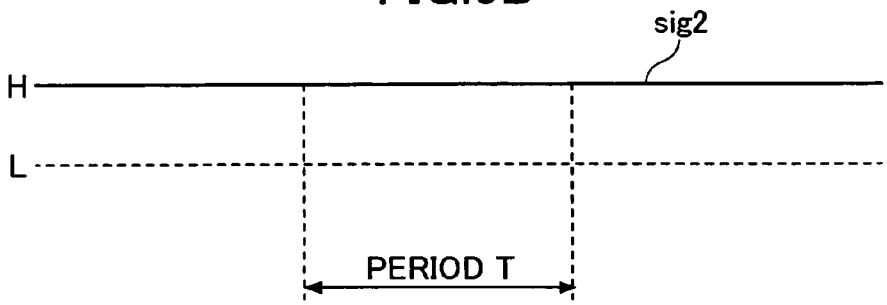

FIG. 5B shows the waveform of a notification signal sig2 which is outputted when an error occurs. When this notification signal sig 2 is received, the error detecting unit 37 determines that an error arises, by detecting only the high-level pulse which does not fall within the period T indicated by the reference value a, without detecting the edge input of the received signal having the pulse width twb. A value which is larger than the period T is set to the reference value a indicated in FIG. 4. The pulse width twb for the detection of the edge input may be set up arbitrarily.

Although the high-level pulse width is used for the edge input in the above example of FIG. 5A, it may be made into the waveform of a low-level notification signal which has the period T and is set at the low level for the pulse width twb within the period T.

Figure 6:
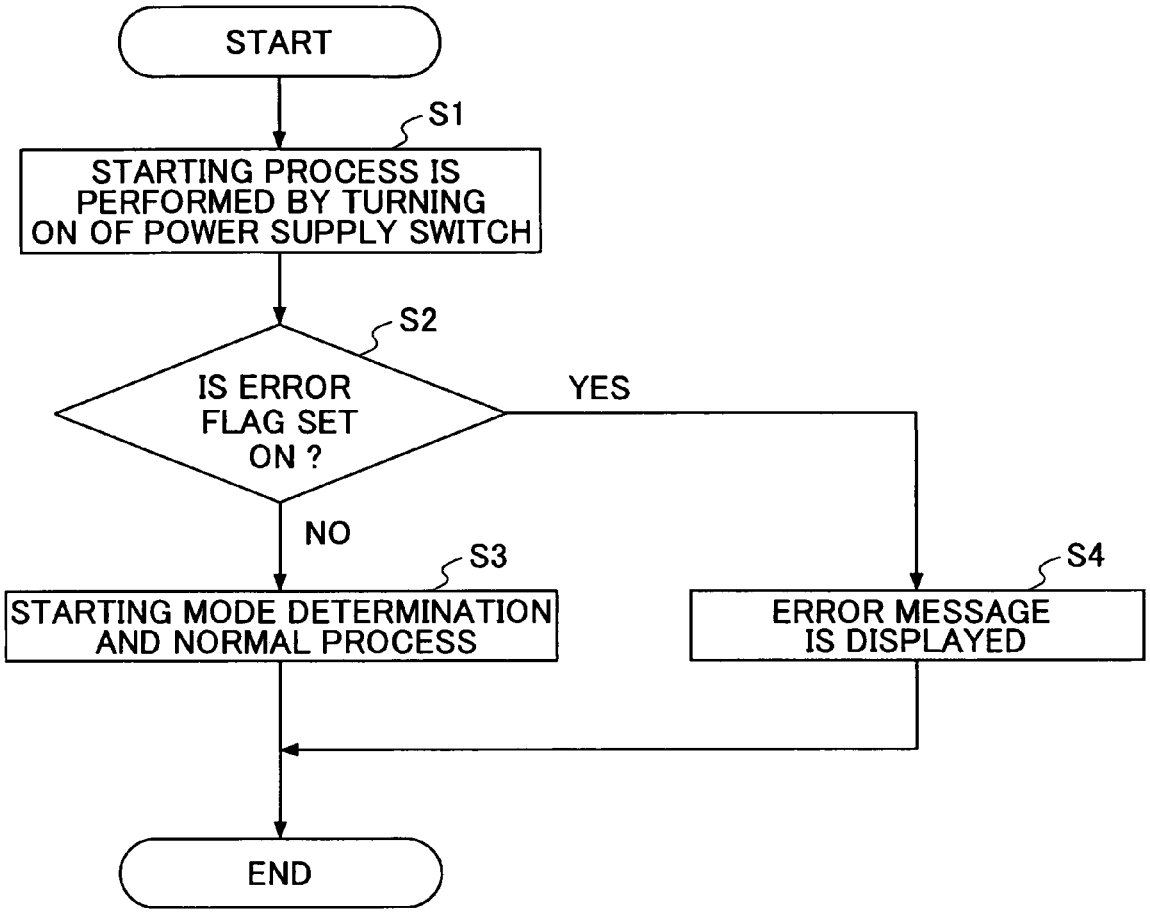
FIG. 6 is a flowchart for explaining the processing performed by the engine control unit of the image forming device of the invention when a return factor to the normal mode occurs during the power saving mode.

FIG. 6 is a flowchart for explaining the processing performed by the engine control unit of the image forming device of the invention when a return factor to the normal mode occurs during the power saving mode.

In this example, the engine control unit 30 performs the processing of FIG. 6 when the power switch of the digital copier of FIG. 1 is turned ON.

At step S1, the engine control unit 30 performs starting processing upon the power ON. At step S2, the engine control unit 30 determines whether the error flag F outputted from the error detecting unit 37 is set in ON state (asserted).

When the error flag F is not set in ON state, the engine control unit 30 at step S3 performs the starting mode determination and the normal processing. And the processing of FIG. 6 is terminated.

When the error flag is set in ON state at step S2, the engine control unit 30 at step S4 displays an error message on the operation panel. In this manner, the engine control unit 30 displays an error message when the asserted state of the error flag F is detected.

When the notification signal sig2 is continuously set at the high (H) level or low (L) level" over the period of the fixed time as shown in FIG. 5B, the engine control unit 30 determines that an error arises. The engine control unit 30 is able to detect occurrence of an error of the system control unit 2 before the software (program) of the system control unit is started. Thus, it is possible to notify the user of an abnormal condition quickly upon power up of the image forming device.

As described in the foregoing, the image forming device of the invention is applicable also to image forming devices which perform image formation, including printing devices and facsimile devices.

The present invention is not limited to the above-described embodiments, and variations and modifications may be made without departing from the scope of the present invention.

Further, the present application is based on and claims the benefit of priority of Japanese patent application No. 2005-196628, filed on Jul. 5, 2005, and Japanese patent application No. 2006-154978, filed on Jun. 2, 2006, the entire contents of which are hereby incorporated by reference.

What is claimed is:

1. An image forming device comprising:

a system control unit;

an image formation unit to form an image on a recording sheet using a predetermined process;

an image forming control unit to control image formation by the image formation unit;

a power supply unit to supply power to at least the image formation unit, the image forming control unit, and the system control unit in response to a control signal received from the system control unit;

a return factor monitoring unit provided in the system control unit to detect occurrence of a return factor to a normal mode during a power saving mode, wherein the return factor monitoring unit outputs, when occurrence of a return factor to the normal mode during the power saving mode is detected, a notification signal indicating return factor information relating to the detected return factor, to the image forming control unit before starting of the system control unit is completed; and an initialization necessity judgment unit to determine whether initializing the predetermined process is needed at a time of returning to the normal mode, based on the return factor information indicated by the notification signal.

2. The image forming device according to claim 1 wherein the return factor monitoring unit is provided to output a pulse-width-modulation pulse carrying the return factor information relating to the detected return factor, to the image forming control unit via one or more communication lines.

3. The image forming device according to claim 2 further comprising an error detecting unit to determine that an error arises, when a pulse-width-modulation pulse outputted by the return factor monitoring unit is continuously at high level or low level over a period of a fixed time.

4. The image forming device according to claim 1 wherein the power supply unit is provided to supply power to the return factor monitoring unit even in the power saving mode, so that the return factor monitoring unit operates in the power saving mode.

5. The image forming device according to claim 1 wherein, the system control unit is provided to control the power supply unit to resume the supply of power to at least the image formation unit, the image forming control unit, and the system control unit when the return factor monitoring unit detects occurrence of a return factor to the normal mode during the power saving mode.

6. The image forming device according to claim 1 wherein the initialization necessity judgment unit is provided to determine whether initializing an electrophotographic process used by the image formation unit is needed at the time of returning to the normal mode, based on a code indicated by a digital signal which is received as the notification signal from the return factor monitoring unit.

7. The image forming device according to claim 1 wherein the initialization necessity judgment unit is provided to determine whether initializing an electrophotographic process used by the image formation unit is needed at the time of returning to the normal mode, based on a pulse width of a pulse-width-modulation pulse which is received as the notification signal from the return factor monitoring unit.

8. The image forming device according to claim 1 wherein the return factor monitoring unit is provided to control the power supply unit in the normal mode to supply power to at least the image formation unit, the image forming control unit, and the system control unit, and provided to control the power supply unit in the power saving mode to stop the supply of power to the image formation unit, the image forming control unit, and the system control unit.

9. The image forming device according to claim 1 wherein the image forming control unit is connected to the system control unit through a command line.

10. A method of controlling an image forming device comprising a system control unit, an image formation unit to form an image on a recording sheet using a predetermined process, an image forming control unit to control the image formation by the image formation unit, and a power supply unit to supply power to at least the image formation unit, the image forming control unit, and the system control unit in response to a control signal received from the system control unit, and a return factor monitoring unit provided in the system control unit to detect occurrence of a return factor to a normal mode during a power saving mode, the method comprising:

outputting, when occurrence of a return factor to the normal mode is detected during the power saving mode, a notification signal indicating return factor information relating to the detected return factor, to the image forming control unit before starting of the system control unit is completed; and determining whether initializing the predetermined process is needed at a time of returning to the normal mode, based on the return factor information indicated by the notification signal.

* * * * *